US010480743B2

(12) United States Patent
Gao et al.

(10) Patent No.: US 10,480,743 B2
(45) Date of Patent: Nov. 19, 2019

(54) LIGHT BEAM ADJUSTING DEVICE AND VEHICLE LAMP ASSEMBLY

(71) Applicant: Valeo Lighting Hubei Technical Center Co. Ltd, Wuhan (CN)

(72) Inventors: Yagui Gao, Wuhan (CN); Chen Chen, Wuhan (CN)

(73) Assignee: Valeo Lighting Hubei Technical Center Co. Ltd, Wuhan (CN)

( * ) Notice: Subject to any disclaimer, the term of this patent is extended or adjusted under 35 U.S.C. 154(b) by 0 days.

(21) Appl. No.: 15/963,528

(22) Filed: Apr. 26, 2018

(65) Prior Publication Data

US 2018/0313505 A1 Nov. 1, 2018

(30) Foreign Application Priority Data

Apr. 27, 2017 (CN) ..... 2017 2 0457531 U

(51) Int. Cl.
*F21S 41/20* (2018.01)
*F21S 43/237* (2018.01)
(Continued)

(52) U.S. Cl.
CPC ..... *F21S 41/285* (2018.01); *F21S 41/141* (2018.01); *F21S 41/24* (2018.01); *F21S 41/30* (2018.01);
(Continued)

(58) Field of Classification Search
CPC ..... F21S 41/285
(Continued)

(56) References Cited

U.S. PATENT DOCUMENTS 5,490,049 A * 2/1996 Montalan ..... B60Q 1/2696 362/240
6,097,549 A * 8/2000 Jenkins ..... B60Q 1/302 359/726
(Continued)

FOREIGN PATENT DOCUMENTS

DE 10 2006 028 961 A1 12/2007
DE 20 2016 008 100 U1 2/2017
(Continued)

OTHER PUBLICATIONS

European Search Report dated Aug. 31, 2018 in Patent Application No. 18 16 8522, 2 pages.

*Primary Examiner* — Christopher M Raabe
(74) *Attorney, Agent, or Firm* — Oblon, McClelland, Maier & Neustadt, L.L.P.

(57) ABSTRACT

A light beam adjusting device includes a first optical deflection unit having a first light incidence face and a first light exit face, the first optical deflection unit being arranged to deflect light which is incident from the first light incidence face and which exits from the first light exit face at a first deflection angle. A second optical deflection unit has a second light incidence face and a second light exit face, the second light incidence face being arranged to face the first light exit face and including an array of prisms arranged to deflect the light exiting from the first light exit face at a second deflection angle. The light beam adjusting device obtains the desired deflection direction of the incident light beam by a compact structure providing two-stages of optical deflection units to achieve the deflection of an incident light beam.

22 Claims, 5 Drawing Sheets

(51) Int. Cl.

| | |
|---|---|
| ***F21S 43/239*** | (2018.01) |
| ***F21S 43/245*** | (2018.01) |
| ***F21S 43/249*** | (2018.01) |
| ***F21S 43/247*** | (2018.01) |
| ***F21S 43/31*** | (2018.01) |
| ***F21S 43/243*** | (2018.01) |
| ***F21S 41/24*** | (2018.01) |
| ***F21S 41/30*** | (2018.01) |
| ***F21S 43/40*** | (2018.01) |
| ***F21S 43/14*** | (2018.01) |
| ***F21S 43/30*** | (2018.01) |
| ***F21S 41/141*** | (2018.01) |
| ***F21S 43/235*** | (2018.01) |
| ***F21S 43/20*** | (2018.01) |
| *F21Y 115/10* | (2016.01) |
| *F21W 103/10* | (2018.01) |
| *F21W 103/35* | (2018.01) |
| *F21W 103/20* | (2018.01) |

(52) U.S. Cl.

CPC ..... *F21S 43/14* (2018.01); *F21S 43/235* (2018.01); *F21S 43/237* (2018.01); *F21S 43/239* (2018.01); *F21S 43/243* (2018.01); *F21S 43/245* (2018.01); *F21S 43/247* (2018.01); *F21S 43/249* (2018.01); *F21S 43/26* (2018.01); *F21S 43/30* (2018.01); *F21S 43/315* (2018.01); *F21S 43/40* (2018.01); *F21W 2103/10* (2018.01); *F21W 2103/20* (2018.01); *F21W 2103/35* (2018.01); *F21Y 2115/10* (2016.08)

(58) Field of Classification Search

USPC ..... 362/511

See application file for complete search history.

(56) References Cited

U.S. PATENT DOCUMENTS

| | | | | |
|---|---|---|---|---|
| 7,401,948 | B2 * | 7/2008 | Chinniah | F21V 5/04 362/326 |
| 2008/0013313 | A1 | 1/2008 | Schroll | |
| 2014/0211493 | A1 * | 7/2014 | Ichikawa | F21V 7/0025 362/511 |
| 2014/0321137 | A1 * | 10/2014 | Chen | G02B 6/003 362/511 |
| 2015/0003094 | A1 | 1/2015 | Gebauer et al. | |
| 2015/0129305 | A1 * | 5/2015 | Yoshida | H01B 1/02 174/72 C |
| 2015/0330588 | A1 * | 11/2015 | Snyder | F21S 41/285 362/516 |
| 2016/0033101 | A1 * | 2/2016 | Yan | F21S 41/143 362/520 |
| 2017/0009949 | A1 * | 1/2017 | Kumar | F21S 41/143 |
| 2017/0122528 | A1 * | 5/2017 | Kadoriku | F21S 41/00 |
| 2018/0238510 | A1 * | 8/2018 | Gloss | F21S 41/143 |

FOREIGN PATENT DOCUMENTS

| | | | |
|---|---|---|---|
| DE | 20 2015 008 368 | U1 | 3/2017 |
| EP | 2 230 446 | A1 | 9/2010 |
| EP | 2 317 214 | A1 | 5/2011 |
| EP | 2 530 372 | A1 | 12/2012 |
| EP | 2 818 791 | A1 | 12/2014 |

* cited by examiner

100

LIGHT BEAM ADJUSTING DEVICE AND VEHICLE LAMP ASSEMBLY

BACKGROUND OF THE DISCLOSURE

Field of the Disclosure

The present application relates to lighting and signaling field, more particularly to a light beam adjusting device and a vehicle lamp assembly including the light beam adjusting device.

Description of the Related Art

A lighting or signaling apparatus, for example, a vehicle lamp, is one of important parts of a motor vehicle. Traffic regulations and industrial standards have specific requirements on the distribution of light intensity of the light emitted from various types of vehicle lamps (for example, headlamps, stop lamps, turn indicators, and so on). Thus, an exit light beam from the vehicle lamp needs to be adjusted by an optical system before the beam is emitted from the vehicle lamp.

However, on the other hand, it is desired that the space occupied by components in the vehicle lamp and the orientation of the components become more flexible, to adapt for style design of various types of lamps. The conventional device for adjusting the light beam for the vehicle lamp has single function and has stiff requirements on the space and arrangement of the components. For example, when a printed circuit board carrying a light source is inclined with respect to a light emitting direction of the vehicle lamp, it may cause significant effects on adjustments of the light beam and thus it is difficult to obtain desired exit light beam for the vehicle lamp.

SUMMARY

The present application is intended to provide a light beam adjusting device that can adjust a light beam when the light emitting axis of the light source is inclined with respect to the light emitting direction of a vehicle lamp, so as to reduce limit on the style of lamp and space design.

The present application is also intended to provide a vehicle lamp assembly including the light beam adjusting device.

An embodiment of the present application provides a light beam adjusting device, comprising: a first optical deflection unit having a first light incidence face and a first light exit face, the first optical deflection unit being arranged to deflect a light which is incident from the first light incidence face and exits from the first light exit face at a first deflection angle; and a second optical deflection unit having a second light incidence face and a second light exit face, the second light incidence face being arranged to face the first light exit face, and the second light incidence face being provided with an array of prisms which are arranged to deflect the light exiting from the first light exit face at a second deflection angle.

In an embodiment, the second light exit face is provided with a plurality of light distribution protrusions arranged to adjust a distribution of intensity of the light which is deflected by the second light incidence face and exits from the second light exit face.

In an embodiment, each one of the light distribution protrusions has a surface with a shape arranged to disperse the part of the light beam passing through the one of the light distribution protrusions along a predetermined direction.

In an embodiment, all of prisms in the array of prisms on the second incidence face extend along a same direction.

In an embodiment, the second light exit face has a whole shape of an entire ring or a part of a ring.

In an embodiment, each one of the light distribution protrusions has a surface with a convex shape.

In an embodiment, a collimator for collimating the incident light beam is provided on the first light incidence face.

In an embodiment, the collimator comprises a transmittive collimating portion arranged at a central region of the collimator and a totally reflection collimating portion arranged at a lateral region of the collimator.

In an embodiment, the first light exit face is also provided with an array of prisms, and wherein the array of prisms on the first light exit face has one or more first deflection faces and the array of prisms on the second light incidence face has second deflection faces in one-to-one correspondence with the first deflection faces, and wherein each of the first deflection faces is inclined with respect to an axis of the light beam directed on the first light exit face such that the part of light beam passing through the first deflection face is deflected towards the corresponding one of the second deflection faces.

In an embodiment, each of the first deflection faces is inclined with respect to an axis of the light beam directed on the first light exit face at an inclination angle which is arranged such that the part of the light beam passing through the first deflection face is deflected at the first deflection angle.

In an embodiment, each of the second deflection faces is inclined with respect to an axis of the light beam directed on the first light exit face at an inclination angle which is arranged such that the part of the light beam passing through the first deflection face is deflected at the second deflection angle.

In an embodiment, the first deflection face is inclined with respect to an axis of the light beam directed on the first light exit face at an inclination angle greater than 40 degrees.

In an embodiment, all of prisms in the array of prisms on the first light exit face extend along a same direction.

In an embodiment, the first optical deflection unit and the second optical deflection unit are formed integrally and there is a gap between the first light exit face and the second light incidence face.

In an embodiment, the first optical deflection unit comprises a light guide member, and the first light incidence face is located at an end of the light guide member, and the first light exit face is located on a side of the light guide member facing the second light incidence face, and wherein one or more decoupling reflective faces are arranged on the side of the light guide member facing away from the second light incidence face and configured to reflect the incident light beam from the first light incidence face towards the second light incidence face.

In an embodiment, the light beam reflected by the decoupling reflective faces exits from the first light exit face in a direction perpendicular to the first light exit face.

In an embodiment, one or more third deflection faces are arranged on the second light incidence face and deflect the light beam exiting from the first light exit face.

In an embodiment, the first deflection angle is greater than zero degree and less than 40 degrees.

In an embodiment, the second deflection angle is greater than zero degree and less than 40 degrees.

An embodiment of the present application provides a vehicle lamp assembly, comprising: the light beam adjusting device as described in any one of the above embodiments; and a light source emitting a light beam to the first light incidence face.

In an embodiment, the angle between an emitting axis of the light source and an axis of an exit light beam of the vehicle lamp is equal to the sum of the first deflection angle and the second deflection angle.

In an embodiment, the light source comprises one or more solid state light sources.

In an embodiment, the solid state light sources comprise light emitting diodes.

With the light beam adjusting device as described in the above of at least one embodiments of the present application, two-stages of optical deflection units are provided to achieve the deflection of an incident light beam. The light beam adjusting device can obtain the desired deflection direction of the incident light beam by a compact structure. It is suitable in particular for an inclined light emitting axis of the light source.

DETAILED DESCRIPTION OF PREFERRED EMBODIMENTS

Figure 1:
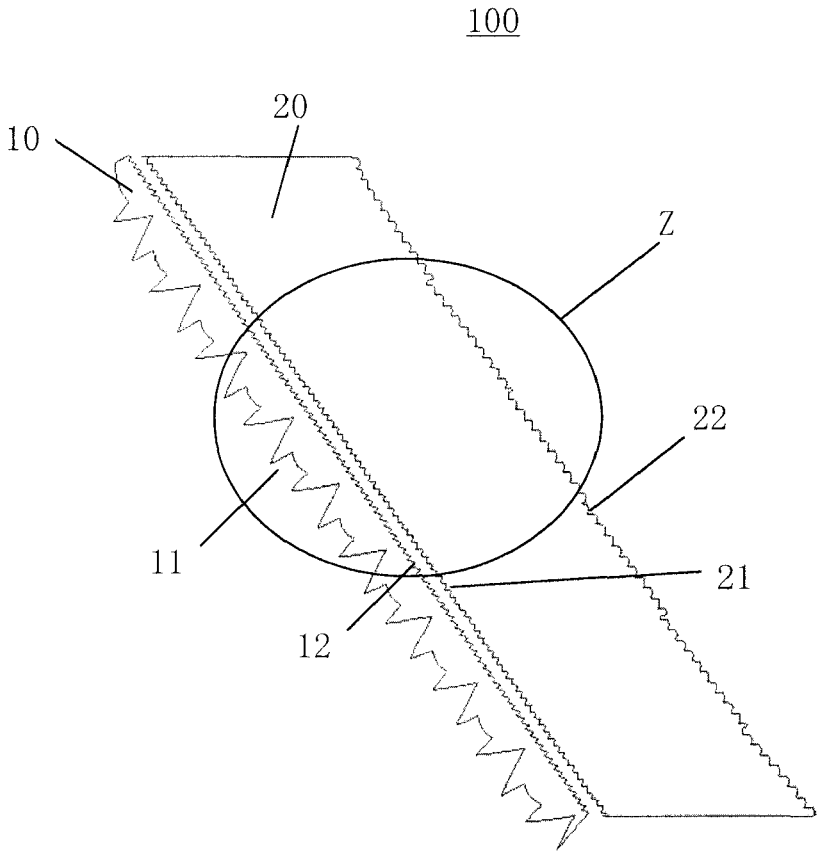
FIG. 1 is a schematic side cross sectional view showing a light beam adjusting device according to an embodiment of the present application.

Embodiments of the present application will below be explained in details by ways of examples with reference to the accompanying drawings. Throughout the description, same or similar reference numerals represent same or similar parts. The following description of the embodiments with reference to the drawings is intended to explain the general inventive concept of the present application, instead of limiting the present application.

In accordance with a general concept of the present application, it provides a light beam adjusting device. The light beam adjusting device includes: a first optical deflection unit having a first light incidence face and a first light exit face, the first optical deflection unit being arranged to deflect a light at a first deflection angle, which is incident from the first light incidence face and exits from the first light exit face; and a second optical deflection unit having a second light incidence face and a second light exit face, the second light incidence face being arranged to face the first light exit face, and the second light incidence face comprising an array of prisms which is arranged to deflect the light exiting from the first light exit face at a second deflection angle.

In addition, in the following detailed description, for purposes of explanation, numerous specific details are set forth in order to provide a thorough understanding of the disclosed embodiments. It will be apparent, however, that one or more embodiments may be practiced without these specific details.

FIG. 1 schematically shows a light beam adjusting device 100 according to an embodiment of the present application. The light beam adjusting device 100 includes a first optical deflection unit 10 and a second optical deflection unit 20. The first optical deflection unit 10 has a first light incidence face 11 and a first light exit face 12. The first optical deflection unit 10 is arranged to deflect a light which is incident from the first light incidence face 11 and exits from the first light exit face 12, at a first deflection angle $\alpha 1$ (as shown specifically in FIG. 2). The second optical deflection unit 20 has a second light incidence face 21 and a second light exit face 22. The second light incidence face 21 is arranged to deflect the light exiting from the first light exit face 12 at a second deflection angle $\alpha 2$ (as shown specifically in FIG. 2). An array of prisms is provided on the second light incidence face 21. The array of prisms is arranged to deflect the light exiting from the first light exit face 12. The second light incidence face 21 and the first light exit face 12 may be arranged to face towards each other. It may achieve compact design of the light beam adjusting device 100, to reduce the space which it needs to occupy.

By means of the light beam adjusting device 100 according to an embodiment of the present application, the direction and light intensity distribution of the light beam incident into the first light incidence face 11 can be adjusted. By means of the first optical deflection unit 10 and the second optical deflection unit 20 deflecting the light beam two times, the light beam may be emitted out successfully along a desired light emitting direction even if an axis of the incident light beam of the light beam adjusting device 100 is inclined at a large angle with respect to the desired light emitting direction.

Figure 2:
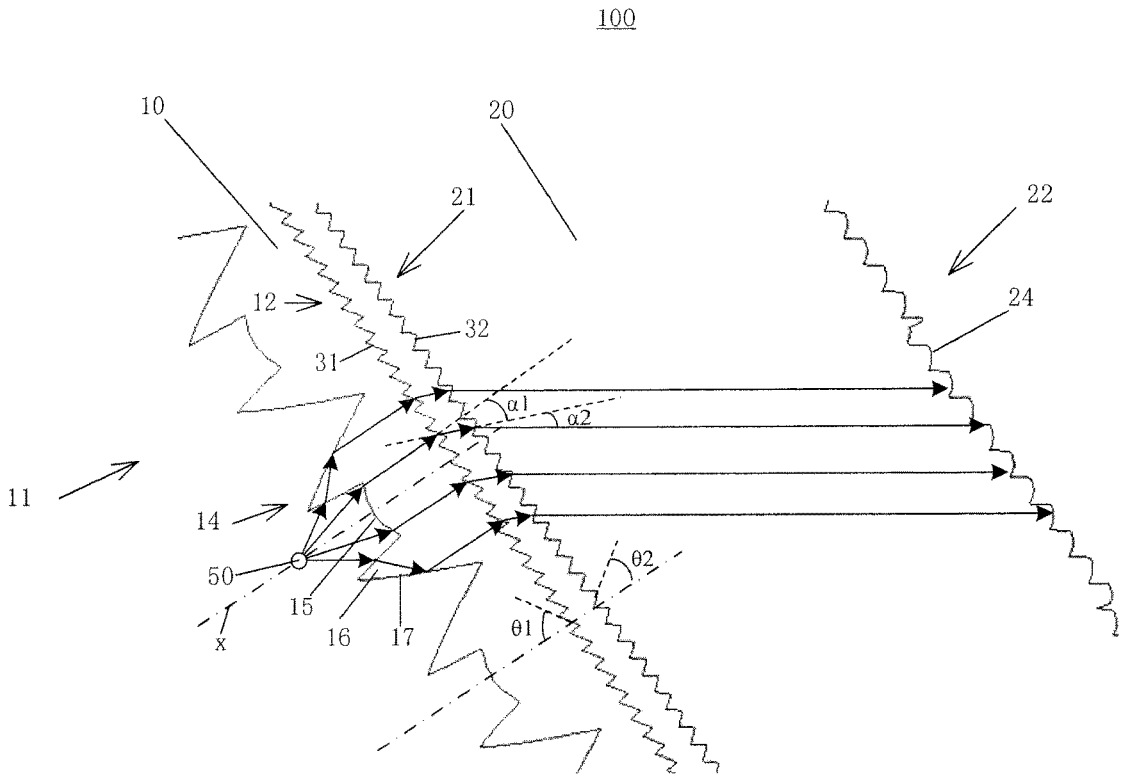
FIG. 2 is an enlarged schematic view of the local part Z of the light beam adjusting device shown in FIG. 1, in which an optical path is shown.
Figure 7:
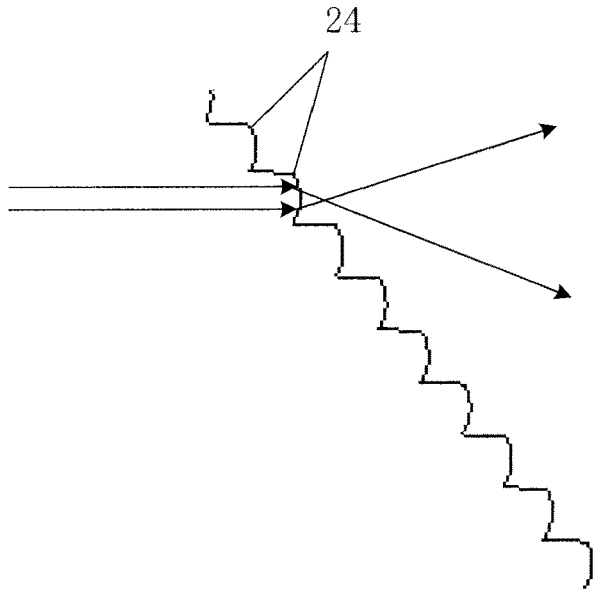
FIG. 7 is a schematic view showing an example of light distribution protrusions that may be applied on a second light emitting face of the light beam adjusting device according to an embodiment of the present application.

As an example, the second light exit face 22 may be provided with a plurality of light distribution protrusions 24 (shown in FIG. 2 and FIG. 7). The plurality of light distribution protrusions 24 are arranged to adjust a distribution of intensity of the light which is deflected by the second light incidence face 21 and exits from the second light exit face 22. Use of the second light exit face 22 with the plurality of light distribution protrusions 24 may adjust the distribution of intensity of the exit light beam into a desired distribution. For example, the distribution of intensity may become more uniform, or alternatively the distribution of intensity at different distances from the second light exit face 22 may be adjusted, to satisfy requirements on specification of vehicle lamps for motor vehicles (for example, Chinese National Standards, European Standards, and so on). As an example, each of the light distribution protrusions 24 may have a surface shape arranged to adjust the distribution of intensity of the light beam which has been deflected by the second light incidence face and exits from the second light exit face, in order to satisfy the specification for any one of vehicle lamps for motor vehicles.

FIG. 7 schematically shows effects of exemplified light distribution protrusions 24 on the light beam. In FIG. 7, the direction along which the light beam travels is indicated schematically by solid arrows. As an example, the surface shape of each of the light distribution protrusions 24 may be arranged to disperse the part of the light beam passing through the one of the light distribution protrusions 24 along predetermined directions. For example, each one of the light distribution protrusions 24 may have a surface with a convex shape. It should be noted that when the surface of the one of the light distribution protrusions 24 has the convex shape, the surface may at first converge the light beam due to its optical property, however, the converged light beam will become a divergent light beam after the converged light beam passes through a convergent point, thus, the convex shape also may be used to achieve effects of dispersing the light beam. As shown in FIG. 7, different surface shapes (for example, curvature or inclined shapes) of the light distribution protrusions 24 can change the light intensity distribution at different distances from the second light exit face 22, for example, can form concentrated light intensity on the cross section of the light beam at a certain distance from the second light exit face 22 to satisfy the desired illumination requirements. The specific parameters depend on the design requirements for different functions of vehicle lamps. Regarding the design requirements for different functions of vehicle lamps, please refer to the relevant technical specifications in the art. The details will be omitted herein. The converging or dispersing effects of the light distribution protrusions 24 on parts of the light beam may be achieved by refraction of the surfaces of the light distribution protrusions 24 to the parts of the light beam.

In an example, as shown in FIG. 1 and FIG. 2, the first light exit face 12 is also provided with an array of prisms. The array of prisms on the first light exit face 12 has one or more first deflection faces 31 and the array of prisms on the second light incidence face 21 has second deflection faces 32 in one-to-one correspondence with the first deflection faces 31. Each of the first deflection faces 31 is inclined with respect to an axis (x) of the light beam directed on the first light exit face 12 such that the part of light beam passing through the first deflection face 31 is deflected towards the corresponding one of the second deflection faces 32. In FIG. 2, the direction along which the light travels is indicated by solid arrows.

Such design of double arrays of prisms (the first light exit face 12 is provided with the array of prisms and the second light exit face 21 is provided with the array of prisms) can achieve two-stage deflection (i.e., it is achieved by the first deflection faces 31 and the second deflection face 32 respectively), so that sufficiently large deflection angle of the light beam can be achieved by the compact structure. In the embodiment, the deflection of the light beam by the first deflection face 31 and the second deflection face 32 is achieved on a basis of optical refraction principle. The specific deflection angle depends on orientations of the first deflection face 31 and the second deflection face 32 (or incident angles of the light beam onto the first deflection face 31 and the second deflection face 32), refractivity of material of the first optical deflection unit 10, refractivity of material of the second optical deflection unit 20 and refractivity of medium in a gap between the first light exit face 12 and the second light exit face 21. Since the optical refraction principle is well-known in the art, its details will be omitted here.

In an example, each of the first deflection faces 31 is inclined with respect to an axis (x) of the light beam directed on the first light exit face 12 at an inclination angle $\theta 1$. And the inclination angle $\theta 1$ is arranged such that the part of the light beam passing through the first deflection face 31 is deflected at the first deflection angle $\alpha 1$. That is, in this example, the deflection of the first optical deflection unit 10 to the light beam is achieved substantially only by the first deflection face 31. It may simplify the structure of the first optical deflection unit 10.

Similarly, as an example, each of the second deflection faces 32 is inclined with respect to an axis (x) of the light beam directed on the first light exit face 12 at an inclination angle $\theta 2$. And the inclination angle $\theta 2$ is arranged such that the part of the light beam passing through the first deflection face 31 is deflected at the second deflection angle $\alpha 2$. That is, in this example, the deflection of the second optical deflection unit 20 to the light beam is achieved substantially only by the second deflection face 32. It may simplify the structure of the second optical deflection unit 20.

As an example, the inclination angle $\theta 1$ of the first deflection face 31 with respect to the axis of the light beam directed on the first light exit face 12 may be sufficiently large to better meet the demands of the deflection of the light beam, for example, the inclination angle $\theta 1$ may be greater than 40 degrees.

In an example, the first optical deflection unit 10 and the second optical deflection unit 20 are formed integrally and there is a gap between the first light exit face 12 and the second light incidence face 21. It may reduce difficulty of manufacturing the light beam adjusting device 100 according to an embodiment of the present application. It is also helpful to ensure the positional relationship between the first light exit face 12 and the second light incidence face 21. However, embodiments of the present application are not limited to this. For example, the first optical deflection unit 10 and the second optical deflection unit 20 may be manufactured respectively and then be assembled together.

Figure 3:
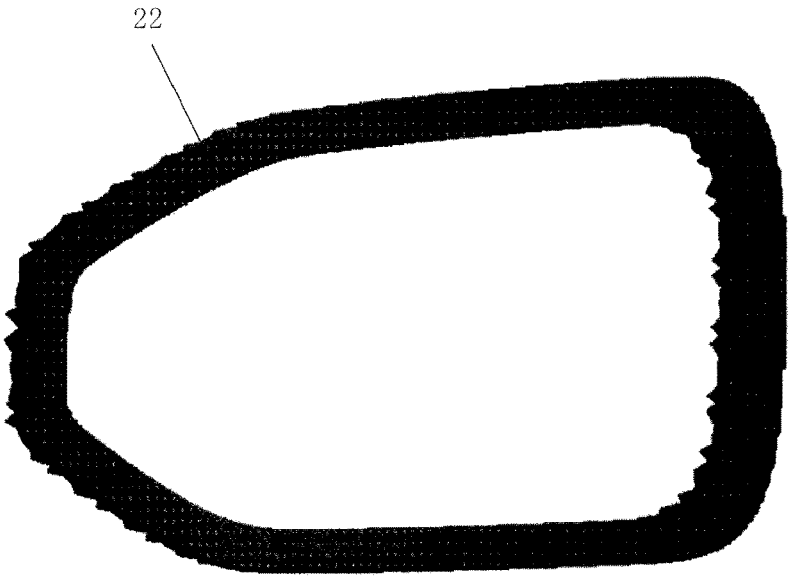
FIG. 3 is a schematic view showing a front profile of the light beam adjusting device according to an embodiment of the present application.

FIG. 3 is a schematic view showing a front profile of the light beam adjusting device 100 according to an embodiment of the present application. The figure is obtained by observing the light beam adjusting device 100 from one side where the second light exit face 22 is located. In the example shown in FIG. 3, the second light exit face 22 may have a whole shape of an entire ring. It should be noted that the ring mentioned herein is not only limited to a circular ring, and it may alternatively be a regular ring, an elliptical ring or even an irregular closed ring. In another example, alternatively, the whole shape of the second light exit face 22 may be arranged as a part of a ring (or called as an unclosed ring).

In an example, a collimator 14 for collimating the incident light beam may be provided on the first light incidence face 11. The collimator 14 may convert the incident light beam into a parallel light beam or a light beam similar to a parallel light beam, such that the incident light beam can be directed on the first light exit face 12 at a substantially constant angle. In this way, the design of the deflection faces on the first light incidence face 11 and the first light exit face 12 can be simplified and the errors caused by difference in direction of the incident light can be reduced.

In an example, the collimator 14 may include a transmittive collimating portion 15 arranged at a central region of the collimator 14 and a totally reflection collimating portion 16 arranged at a lateral region of the collimator 14. As shown in FIG. 2, the transmittive collimating portion 15 may for example have a surface shape in form of a convex lens. The transmittive collimating portion 15 may be configured to collimate a central part of the incident light beam. The totally reflection collimating portion 16 is provided with a totally reflection face 17. The totally reflection face 17 can collimate lateral part of the incident light beam. Such structure can increase optical coupling efficiency of the incident light beam.

Figure 4:
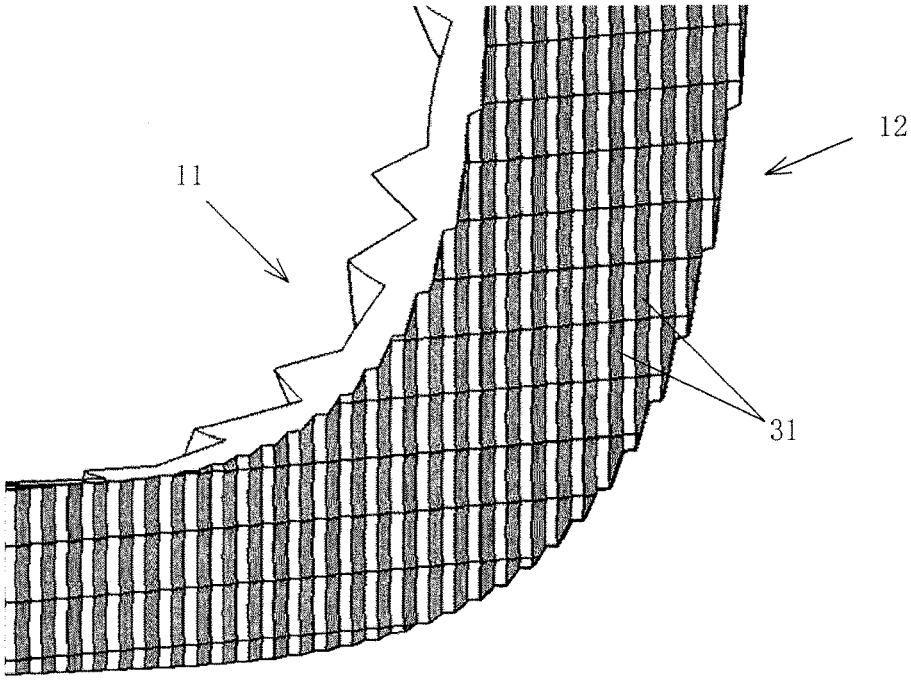
FIG. 4 is a schematic local view of a first optical deflection unit of the light beam adjusting device according to an embodiment of the present application, the first optical deflection unit facing towards a second optical deflection unit.
Figure 5:
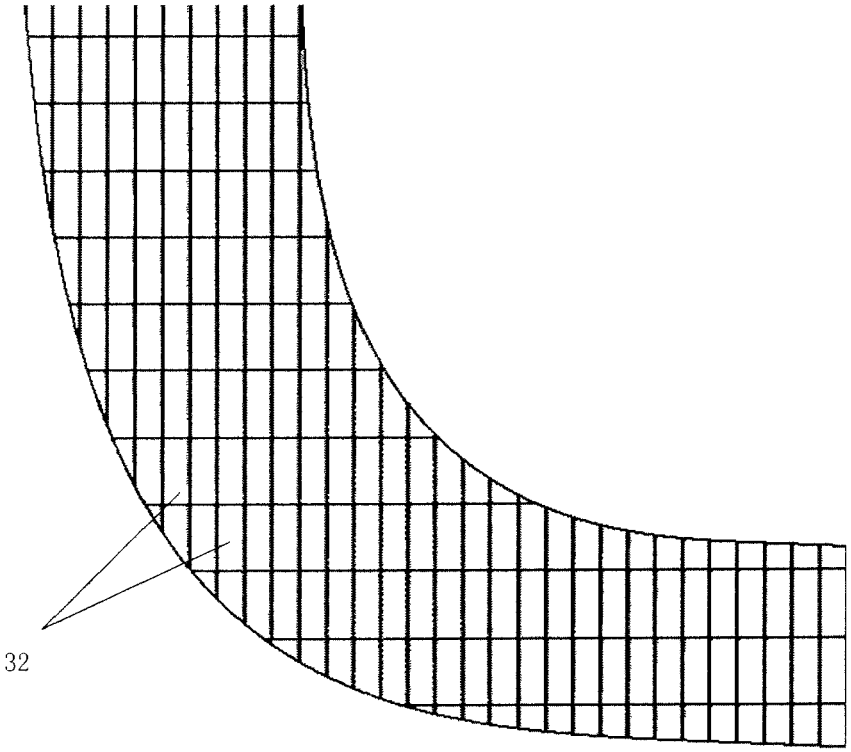
FIG. 5 is a schematic local view of a second optical deflection unit of the light beam adjusting device according to an embodiment of the present application, the second optical deflection unit facing towards the first optical deflection unit.

FIG. 4 is a schematic local view of the first optical deflection unit 10 facing towards the second optical deflection unit 20. It shows the array of prisms arranged on the first light exit face 12. The surfaces indicated by dark patterns are the first deflection faces 31. As an example, the first deflection faces 31 may be arranged in parallel (for example, in a vertical direction). FIG. 5 is a schematic local view of the second optical deflection unit 20 facing towards the first optical deflection unit 10. It shows the array of prisms arranged on the second light incidence face 21. Also, the second deflection faces may be arranged in parallel (for example, in a vertical direction). As an example, all of the prisms in the array of prisms on the first light exit face 12 may extend along a same direction. Similarly, all of the prisms in the array of prisms on the second light incidence face 21 may also extend along a same direction. It may adjust deflection of the light beam around one direction, for example, adjust pitch angle in the vertical direction or side-to-side swinging in the horizontal direction.

Figure 6:
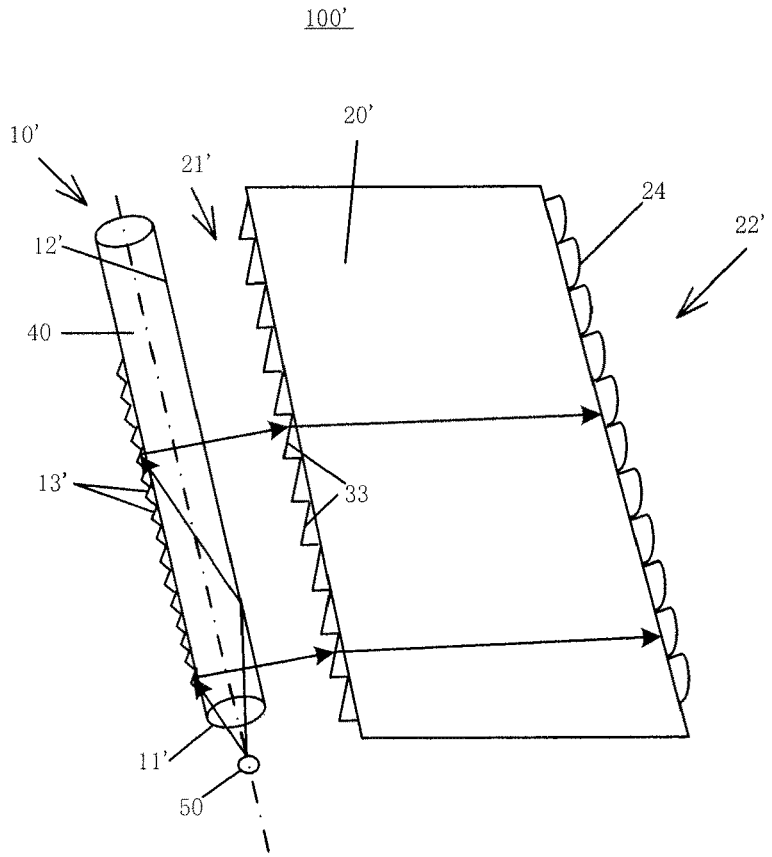
FIG. 6 is a schematic side view showing a light beam adjusting device according to another embodiment of the present application.

FIG. 6 shows a light beam adjusting device 100' according to another embodiment of the present application. In the embodiment, the first optical deflection unit 10' comprises a light guide member 40. The first light incidence face 11' is located at an end of the light guide member 40. The first light exit face 12' is located on a side of the light guide member 40 facing the second light incidence face 21'. One or more decoupling reflective faces 13' are arranged on the side of the light guide member 40 facing away from the second light incidence face 21'. The decoupling reflective faces 13' are configured to reflect the incident light beam from the first light incidence face 11' towards the second light incidence face 21'.

The term of "light guide member" means a member that can guide a light therein mainly by means of total reflection. It may have various shapes, for example, of cylinders (may be called as light guide rods), bars (may be called as light guide bars or lamp bars), plates (may be called as light guide plates), rings (may be called as light guide rings), and so on. As the light is guided mainly by the total reflection, the light guide member has high optical efficiency and low optical loss.

The light guide member guides the light entering the end of the light guide member by the total reflection. Thus, in the light guide member 40, it is typically necessary that the incident light satisfies the total reflection condition at a side wall of the light guide member 40. However, if it is desired for the light in the light guide member 40 to exit from a predetermined position, it will be necessary to destroy the total reflection condition of the light at the predetermined position. For example, a decoupling reflective face 13' (for example, formed by such as prisms) may be provided in at least one region on one side of the light guide member 40. The decoupling reflective face 13' has a function of destroying the total reflection condition of the light in the light guide member 40, such that the light having been reflected by the decoupling reflective face 13' to the first light exit face 12' is not reflected totally, but exits from the light guide member 40. As an example, the decoupling reflective face 13' may be inclined with respect to the light guide member 40. The specific inclination angle depends on refractivity of the light guide member 40 and the incident angle of the light.

In the above embodiment, the first optical deflection unit 10' is implemented as the light guide member 40, other than the previous other embodiments. By means of the light guide member 40, the incident light beam may be deflected to larger extent. That is, it can enhance the first deflection angle. For example, the light beam having been reflected by the decoupling reflective face 13' exits from the first light exit face 12' in perpendicular to the first light exit face 12'. It may be achieved by setting the inclination angle of the decoupling reflective face 13'.

In the embodiments of the present application, the first deflection angle $\alpha 1$ and the second deflection angle $\alpha 2$ depend on the incident angle of the light beam on the first optical deflection unit 10 and the incident angle of the light beam on the second optical deflection unit 20, refractivity of material of the first optical deflection unit 10 and refractivity of material of the second optical deflection unit 20. The sizes of the first deflection angle $\alpha 1$ and the second deflection angle $\alpha 2$ may be set as required. For example, the first deflection angle $\alpha 1$ may be greater than zero degree and less than 40 degrees. As an example, the second deflection angle $\alpha 2$ may be greater than zero degree and less than 40 degrees.

In an example, one or more third deflection faces 33 are arranged on the second light incidence face 21' and deflect the light beam exiting from the first light exit face 12', for example, at the second deflection angle. Similar to the previous embodiments, a plurality of light distribution protrusions 24 configured to adjust the light intensity distribution may also be provided on the second light exit face 22' of the second optical deflection unit 20'.

An embodiment of the present application also provides a vehicle lamp assembly. The vehicle lamp assembly includes the light beam adjusting device 100, 100' as described in any one of the above embodiments; and a light source 50. The light source 50 emits a light beam to the first light incidence face 11, 11'. As an example, the vehicle lamp assembly may be used as a headlamp, a tail lamp, a room lamp, and so on for a motor vehicle.

In an embodiment, the angle between an emitting axis of the light source 50 and an axis of an exit light beam of the vehicle lamp is equal to the sum of the first deflection angle and the second deflection angle.

As an example, the light source 50 may include one or more solid state light sources, for example light emitting diodes. For example, when the light source 50 includes a plurality of light emitting diodes, the plurality of light emitting diodes may be arranged at positions facing different parts of the first light incident face 11, 11', to achieve various desired lit effects. When the printed circuit board carrying the light emitting diodes are inclined due to certain requirements of structure design, the light beam adjusting device 100, 100' and the vehicle lamp assembly according to the embodiments of the present application may adjust the direction and intensity of the light beam emitted from the light source, so as to obtain the exit light beam that meets the requirements for the vehicle lamp.

An embodiment of the present application also provides a vehicle including the vehicle lamp as described in any one of the above embodiments and/or the light beam adjusting device as described in any one of the above embodiments.

In the embodiments of the present application, the first optical deflection unit 10, 10' and the second optical deflection unit 20, 20' may be made from at least partly transparent glass, resin or plastic materials, for example, PMMA (polymethy methacrylate) or polycarbonate. The refractivity of the first optical deflection unit 10, 10' and refractivity of the second optical deflection unit 20, 20' may be for example between 1.3 and 2.0. The first optical deflection unit 10, 10' may have the same refractivity as the second optical deflection unit 20, 20'.

In the embodiments of the present application, the first optical deflection unit 10, 10' and the second optical deflection unit 20, 20' may be supported or suspended by any known suitable devices for holding optical elements, for example a supporting seat or a suspension arm.

The vehicle lamp according to embodiments of the present application may include any types of illumination lamps and/or signaling lamps for a motor vehicle, for example, headlamps, central high mounted stop lamps, turn indicators, position lamps, rear stop lamps and so on.

In the embodiments of the present application, prisms in the array of prisms on the first light exit face 12 and the array of prisms on the second light incidence face 21, 21' may be symmetrical prisms or alternatively may be asymmetrical prisms.

The present disclosure has been explained with reference to drawings. However, the embodiments shown in drawings are intended to exemplarily illustrate the embodiments of the present application by way of examples, instead of limiting the present application. Scales in the drawings are only provided by way of examples, and are not intended to limit the present application.

Although some of embodiments according to a general concept of the present disclosure have been illustrated and explained, the skilled person in the art will understand that these embodiments may be modified without departing from principles and spirits of the present application. The scope of the present application will be defined by the appended claims and equivalents thereof.

What is claimed is:

1. A light beam adjusting device, comprising:

a first optical deflector having a first light incidence face, the first light incidence face comprising a collimator for collimating an incident light, and a first light exit face, the first optical deflector being arranged to deflect the entirety of the incident light and cause it to exit from the first light exit face at a first deflection angle; and a second optical deflector having a second light incidence face and a second light exit face, the second light incidence face being arranged to face the first light exit face, and the second light incidence face comprising an array of prisms which are arranged to deflect the collimated light exiting from the first light exit face along a single direction at a second deflection angle.

2. The light beam adjusting device according to claim 1, wherein the second light exit face comprises a plurality of light distribution protrusions arranged to adjust a distribution of intensity of the light which is deflected by the second light incidence face and exits from the second light exit face.

3. The light beam adjusting device according to claim 2, wherein each one of the light distribution protrusions has a surface with a shape arranged to disperse the part of the light beam passing through the one of the light distribution protrusions along a predetermined direction.

4. The light beam adjusting device according to claim 1, wherein all of prisms in the array of prisms on the second incidence face extend along a same direction.

5. The light beam adjusting device according to claim 1, wherein the second light exit face has a shape of an entire ring or a part of a ring.

6. The light beam adjusting device according to claim 2, wherein each one of the light distribution protrusions has a surface with a convex shape.

7. The light beam adjusting device according to claim 1, wherein the collimator comprises a transmissive collimating portion arranged at a central region of the collimator and a totally reflection collimating portion arranged at a lateral region of the collimator.

8. The light beam adjusting device according to claim 1, wherein the first light exit face also comprises an array of prisms, and wherein the array of prisms on the first light exit face has one or more first deflection faces and the array of prisms on the second light incidence face has second deflection faces in one-to-one correspondence with the first deflection faces, and wherein each of the first deflection faces is inclined with respect to a direction normal to the first light exit face such that the part of light beam passing through the first deflection face is deflected towards the corresponding one of the second deflection faces.

9. The light beam adjusting device according to claim 8, wherein each of the first deflection faces is inclined with respect to a direction normal to the first light exit face at an inclination angle which is arranged such that the part of the light beam passing through the first deflection face is deflected at the first deflection angle.

10. The light beam adjusting device according to claim 9, wherein each of the second deflection faces is inclined with respect to a direction normal to the first light exit face at an inclination angle which is arranged such that the part of the light beam passing through the first deflection face is deflected at the second deflection angle.

11. The light beam adjusting device according to claim 8, wherein the first deflection face is inclined with respect to a direction normal to the first light exit face at an inclination angle greater than 40 degrees.

12. The light beam adjusting device according to claim 8, wherein all of prisms in the array of prisms on the first light exit face extend along a same direction.

13. The light beam adjusting device according to claim 8, wherein the first optical deflector and the second optical deflector are formed integrally and there is a gap between the first light exit face and the second light incidence face.

14. The light beam adjusting device according to claim 1, wherein the first optical deflector comprises a light guide member, and the first light incidence face is located at an end of the light guide member, and the first light exit face is located on a side of the light guide member facing the second light incidence face, and wherein one or more decoupling reflective faces are arranged on the side of the light guide member facing away from the second light incidence face and configured to reflect the incident light beam from the first light incidence face towards the second light incidence face.

15. The light beam adjusting device according to claim 14, wherein the light beam reflected by the decoupling reflective faces exits from the first light exit face in a direction perpendicular to the first light exit face.

16. The light beam adjusting device according to claim 14, wherein one or more third deflection faces are arranged on the second light incidence face and deflect the light beam exiting from the first light exit face.

17. The light beam adjusting device according to claim 1, wherein the first deflection angle is greater than zero degrees and less than 40 degrees.

18. The light beam adjusting device according to claim 1, wherein the second deflection angle is greater than zero degrees and less than 40 degrees.

19. A vehicle lamp assembly, comprising:

a light beam adjusting device comprising a first optical deflector having a first light incidence face, the first light incidence face comprising a collimator for collimating an incident light, and a first light exit face, the first optical deflector being arranged to deflect the entirety of the incident light and cause it to exit from the first light exit face at a first deflection angle; and a second optical deflector having a second light incidence face and a second light exit face, the second light incidence face being arranged to face the first light exit face, and the second light incidence face comprising an array of prisms which are arranged to deflect the collimated light exiting from the first light exit face along a single direction at a second deflection angle; and a light source emitting a light beam to the first light incidence face.

20. The vehicle lamp assembly according to claim 19, wherein the angle between an emitting axis of the light source and an axis of an exit light beam of the vehicle lamp is equal to the sum of the first deflection angle and the second deflection angle.

21. The vehicle lamp assembly according to claim 19, wherein the light source comprises one or more solid state light sources.

22. The vehicle lamp assembly according to claim 21, wherein the solid state light sources comprise light emitting diodes.

* * * * *